US009888744B2

(12) United States Patent
Cogliandro

(10) Patent No.: US 9,888,744 B2
(45) Date of Patent: Feb. 13, 2018

(54) SLIP RESISTANT SHOELACE

(71) Applicant: John Cogliandro, Dedham, MA (US)

(72) Inventor: John Cogliandro, Dedham, MA (US)

( * ) Notice: Subject to any disclaimer, the term of this patent is extended or adjusted under 35 U.S.C. 154(b) by 265 days.

(21) Appl. No.: 14/689,116

(22) Filed: Apr. 17, 2015

(65) Prior Publication Data

US 2016/0302529 A1 Oct. 20, 2016

(51) Int. Cl.

| | |
|---|---|
| ***A43C 7/00*** | (2006.01) |
| ***A43C 1/02*** | (2006.01) |
| ***A43C 9/02*** | (2006.01) |
| ***A43C 1/00*** | (2006.01) |
| ***A43C 9/00*** | (2006.01) |

(52) U.S. Cl.

CPC ..... *A43C 7/005* (2013.01); *A43C 1/00* (2013.01); *A43C 1/02* (2013.01); *A43C 9/00* (2013.01)

(58) Field of Classification Search

CPC .. A43C 7/005; A43C 9/00; A43C 1/02; A43C 1/00

See application file for complete search history.

(56) References Cited

U.S. PATENT DOCUMENTS 1,997,771 A * 4/1935 McGowan ..... D01H 5/36 139/426 R
2,141,801 A * 12/1938 Taft ..... A43C 9/00 24/713
3,110,945 A * 11/1963 Howe, Jr. ..... A43C 9/00 24/713
5,341,758 A * 8/1994 Strickland ..... B63B 35/815 114/253
5,673,546 A * 10/1997 Abraham ..... A43C 9/00 24/713
5,920,970 A * 7/1999 Coblentz ..... A43C 9/00 2/270
2013/0205553 A1* 8/2013 Lin ..... A43C 9/00 24/712
2014/0007392 A1* 1/2014 Kajiwara ..... A43C 9/00 24/715.3
2014/0215777 A1* 8/2014 Lee ..... A43C 1/02 24/713
2015/0047159 A1* 2/2015 Lin ..... A43C 9/00 24/715.4
2015/0257488 A1* 9/2015 Flores ..... A43C 9/00 24/713
2016/0270481 A1* 9/2016 Harden ..... A43C 9/00
2017/0065026 A1* 3/2017 Wu ..... A43C 1/02

* cited by examiner

*Primary Examiner* — Robert Sandy
*Assistant Examiner* — Matthew J Sullivan

(57) ABSTRACT

The present invention is for a slip resistant shoelace comprising a shoelace tube and one or more friction inducing features such as a plurality of beads placed inside the shoelace tube. The plurality of beads of the shoelace interlock with each other while in a knot and thus resist slipping of the knot in the slip resistant shoe lace. The interlocking occurs as one or more beads of the plurality of beads of one section of the slip resistant shoelace fit in space available between two consecutive beads of the plurality of beads of another section of the slip resistant shoelace which are passing over each other in the knot. The interlocking prevents the shoelace from getting loosened and untied inadvertently. The slip resistant shoelace can be tied and untied in the traditional manner.

8 Claims, 10 Drawing Sheets

SLIP RESISTANT SHOELACE

FIELD OF THE INVENTION

The present invention relates to shoelaces. More particularly, the present invention is related to shoelaces that resist unintentional untying of a shoelace knot.

BACKGROUND OF THE INVENTION

There are many needs for shoelaces of all types, such as hiking boots with long heavy duty laces and dress shoes with shorter thin laces and many types of shoes or skates or other equipment with laces of similar descriptions in between. Typical sneakers used for athletes and children are very popular around the world and most use laces that go through grommets/eyelets or similar load leveling devices (holes along the left and right side of the middle of the upper along the forefoot area) and are tied off after adjustment near the top of the foot. This set up is largely ubiquitous across all shoe types and across all countries of the world due to its simplicity, cost, and function. The typical shoe lace system has one serious weakness, as the normal Bowknot which is also known as the Around The Tree or Traditional Knot, or any one of the other common knots of which there are approximately eighteen common knots used in shoe lace tightening, is easily foiled, usually coming undone by itself (lack of firm closure on the knot), or by the users foot stepping on a loose end that was too long due to uneven tying, or due to other circumstances. There are several methods and apparatus on the market to overcome this major weakness of the traditional lace system. Some of the methods include "double knotting" which is a poor solution because the adult or child cannot easily untie the double knot when it comes time to remove the shoe. Other apparatus have been invented with poor results. Most require an "extra step" such as clipping a plastic or metal clip on the knot which can become detached and lost and which detracts from the attractive design of the product, or tucking the laces into special holders sewn into the shoe or other methods, all which are either inadequate or require a behavioral change and additional training.

Some sneakers and shoes specifically targeted to the very young and old and infirm use "Velcro" type hook and loop fasteners to overcome the users' inability or inconvenience of tying a knot in a traditional lace. These shoes use a "Velcro" brand or other brand of "hook and loop" quick fastener instead of traditional laces on the fore foot. This type of fastening system is typically provided in single (small shoes) or double (most others) straps that traverse across the forefoot area in a flap configuration which allows for quick and easy "release" and "tighten" actions, even allowing for one handed release and tighten. These hook and loop straps are useful for their intended purpose, however their unsightly design is unacceptable for designers and style conscious designers and is unacceptable for athletes who need even lacing tension afforded by the traditional lacing set up. Furthermore it is not good for a child to rely on the hook and loop fastener as the child grows up because eventually there will be shoes that do not offer that type of closure system and the child must learn to tie a proper knot.

The typical shoes with its laces going through 2 to 7 or more pairs of opposing grommets for supportive lacing are the most common type worldwide and are generally more anatomically and physically supportive than a sandal, beach flip-flop or canvas casual shoe, and yet less supportive than a heavy duty hiking boot or skate-boot. These supportive shoes are especially necessary for older people who may have become slightly unsteady on their feet and/or wish to avoid stumbling on a pebble or other obstacle and utilize high quality supportive foot wear with even lacing and good high traction soles as an enabler for a more active lifestyle well into the senior years. Likewise toddlers just learning to walk and young adults alike have such active lifestyles with day care, camps, team sports and other activities that require adequate support for their growing feet which is in part provided by the traditional lacing system and adequate traction and support to prevent injury. Likewise various athletes, such as runners, bikers, soccer and the like require specialized high support high cushion athletic footwear which often includes low friction rings as grommets to allow the shoe upper to be tightened around the forefoot for support, and yet flex and give and take tension supplied by the lace during use, which also is best served by a traditional lace system but one that is augmented so as to not inadvertently untie during a critical sporting moment. Ironically, a sport that requires high quality high support footwear is the Triathlete, who starts out swimming with no shoes, but when transitioning from swimming to bicycling to running they require adequate footwear. In order to ease the transition between shoe-less to shoed, the triathletes perform all sorts of practice and rituals, such as lining shoes with silk socks to ease transition of wet feet into the shoe, to reduce the transition time from shoeless swimming to shoed bicycling and running. Once the shoe is on, they quickly tie it and go. The triathlete can be injured or lose valuable time if either shoe becomes untied during the sport, however there is little time to properly tie the shoelace and often wet or hurried hands tie a poor knot which comes undone.

These various people groups and more all require supportive cushioning footwear with a traditional lace system, but also need the laces to remain tied throughout the normal daily activities without the stress and worry of the laces becoming untied inadvertently. Additionally, young people such as a 9 year old child typically exhibits laziness with shoe adornment behavior which is most typically the act of shoving the foot into an unprepared shoe with a tied forefoot due to a double or triple tie knot which is too difficult to untie. The shoe is quickly damaged because the foot is forced on while the laces are still tied, often with the inner support material of the heel counter being crushed thereby ceasing to provide support, ceasing to fit and align properly around the heel and ankle due to malformation.

The elderly exhibit nearly the same problems as the child, but not out of laziness or inability to understand, but due to body stiffness and lack of agility that comes with age they often have trouble tying and untying, and can become frustrated or put in peril if a shoe becomes untied at an inopportune time. Many elderly get help tying laces in the morning and rely on those laces staying tied all day long, however they are often completely unable to untie a double knot if one is used.

Therefore, there is a need for shoelaces which can be tied using a traditional knot but with increased assurance that the traditional knot (with no doubling) will stay knotted securely unless untied by the user.

OBJECTS OF THE INVENTION

An object of the present invention is to provide a shoelace that resists inadvertent untying of shoelace knot, referred to as slip resistant shoe lace.

Another object of the present invention is to provide an anti slip shoelace which can be used in traditional way.

Yet another object of the present invention is to provide a slip resistant shoelace that can be used with conventional shoes instead of common type of shoelaces.

A further object of the present invention is to provide a slip resistant shoelace that does not require any external device for maintaining a shoelace knot.

A still further object of the present invention is to provide a slip resistant shoelace that contains shapes which increase the friction and bond within a shoelace knot and increases the tension required to untie the shoelace knot.

Another object of the present invention is to provide a slip resistant shoelace that contains surface treatments which increase the friction and bond within a shoelace knot and increases the tension required to untie the shoelace knot.

These as well as other objects of the present invention are apparent upon inspection of this specification, including the drawings and appendices attached hereto.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

The present invention is directed to an untie resistant shoelace that can be tied and untied in the traditional manner using simple hand motions already known by most of the people, but resists untying and making it stay more secure during various activities and accidental pulls to the knot system or to the loose ends of a shoelace.

The slip resistant shoelace of the present invention is designed to require little or no major changes to the shoe design and existing lacing system and lacing methods, and yet, once tied, requires greater force to untie than traditional shoelaces.

The slip resistant shoelace includes a shoelace tube inside of which a plurality of beads or pellets are arranged. Any suitable material such as a fabric can be used to fabricate the shoelace tube. The beads or pellets can be made from any suitable material such as plastic or rubber and the size and shape of the beads or pellets can vary depending on the intended use of the slip resistant shoelace. When a knot is tied, wherever the opposite ends of the slip resistant shoelace cross over each other in the knot, the one or more beads present inside one of the ends of the slip resistant shoelace try to fit in between two consecutive beads present in the opposite end of the shoelace. This engagement among the beads belonging to the opposite sides of the shoelace makes it difficult to untie the shoe lace until a user makes use of his hands to do so and the present invention is based on this principle.

To the accomplishment of the foregoing and related ends, certain illustrative aspects of the disclosed invention are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

In order to describe the manner in which features and other aspects of the present disclosure can be obtained, a more particular description of certain subject matter will be rendered by reference to specific embodiments which are illustrated in the appended drawings. Understanding that these drawings depict only typical embodiments and are not therefore to be considered to be limiting in scope, nor drawn to scale for all embodiments, various embodiments will be described and explained with additional specificity and detail through the use of the accompanying drawings in which.

DETAILED DESCRIPTION OF THE INVENTION

Figure 1:
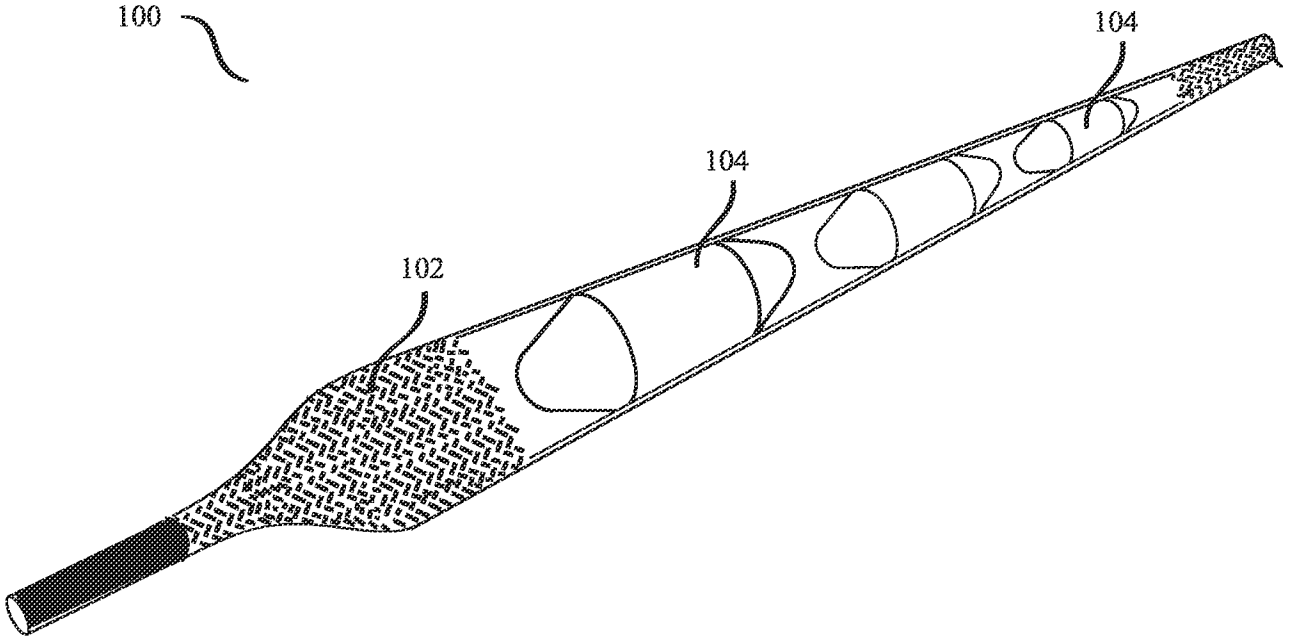
FIG. 1 is a perspective view of a part of a slip resistant shoelace with elongated beads in accordance with an embodiment of the present embodiment.

The following description is presented to enable any person skilled in the art to make and use the invention, and is provided in the context of particular applications of the invention and their requirements. Various modifications, for example but not limited to changes made to ease manufacturing, to the disclosed embodiments will be readily apparent to those skilled in the art and the general principles defined herein may be applied to other embodiments and applications without departing from the scope of the present invention. Thus, the present invention is not intended to be limited to the embodiments shown, but is to be accorded the widest scope consistent with the principles and features disclosed herein.

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as not to obscure the present invention.

Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The slip resistant shoelace of the present invention comprises of a shoelace tube and one or more friction inducing features integrated to the shoelace tube. The term "slip resistant" refers to a knot that requires more tension applied to the lose aglet ends or to the bows or to the shoe to untie than the same knot made in a similar shoe lace without the friction inducing features. Examples of different options for integrating friction inducing features to the shoelace tube include, but not limited to, inclusion of different shaped structures (e.g. beads) inside the shoelace tube, making bump like structures on the shoelace tube itself, adding friction inducing surface such as serrated edges, barbs, hooks or adhesive or friction inducing surface treatments to the exterior of the shoelace tube etc. These friction inducing features increase the friction between two surfaces of the shoelace tube in contact in a knot and, thus, resist loosening of the knot. In other words, the friction inducing features increase the tension or pull that is required to untie a knot. Some of these friction inducing features are described below with reference to drawings. In the ensuing description, the terms anti-slip shoelace and slip resistant shoelace are used alternative and interchangeably.

Figure 2:
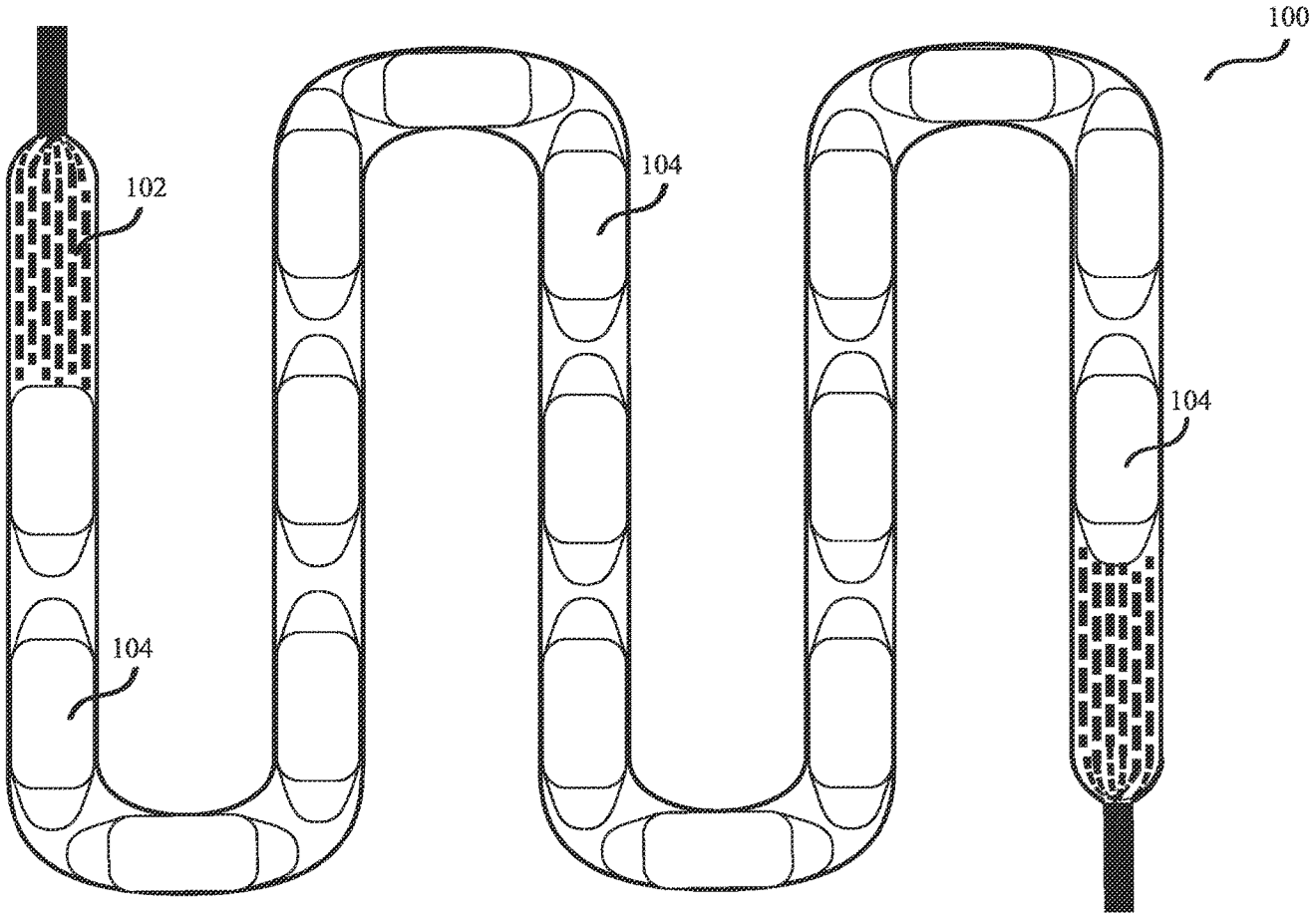
FIG. 2 is a plan view of a full length slip resistant shoelace with elongated beads in accordance with an embodiment of the present embodiment.

FIG. 1 illustrates a perspective view of a slip resistant shoelace 100 in accordance with an embodiment of the present invention. Reference to FIG. 1, the slip resistant shoelace 100 of the present invention comprises of a shoelace tube 102 and plurality of beads 104. The shoelace tube 102 can be of woven using any commonly used fabric—polyester or cotton or can be fabricated using any other suitable material known in the art. The plurality of beads 104 are sewn or glued inside the shoelace tube 102 at some regular or irregular intervals. FIG. 2 illustrates plurality of beads 104 spaced at regular equal intervals inside the shoelace tube 102 throughout the length of the slip resistant shoelace 100. The beads 104 can be of any size and shape. The beads 104 can have rounded or squared ends. Beads aligned inside the shoelace tube 102 with rounded ends facing the aglet end help in feeding the shoelace though the eyelets and the square end of beads facing away from the aglet end help is resisting relative movement between two beads in engaged position. In the embodiment of the slip resistant shoelace 100 shown in FIG. 1 elongated beads 104 are used with rounded ends on both sides of the beads 104. The beads 104 can be made from any suitable material such as rubber, glass, plastic, wood, metal, viscoelastic silicone etc. known in the art. In a preferred embodiment, the beads 104 should be approximately 0.14 inch to 0.177 inch in diameter, made of rubber and the beads 104 should have hardness in the range of 40 international rubber hardness degrees (IRHD) to 80 IRHD.

Figure 3:
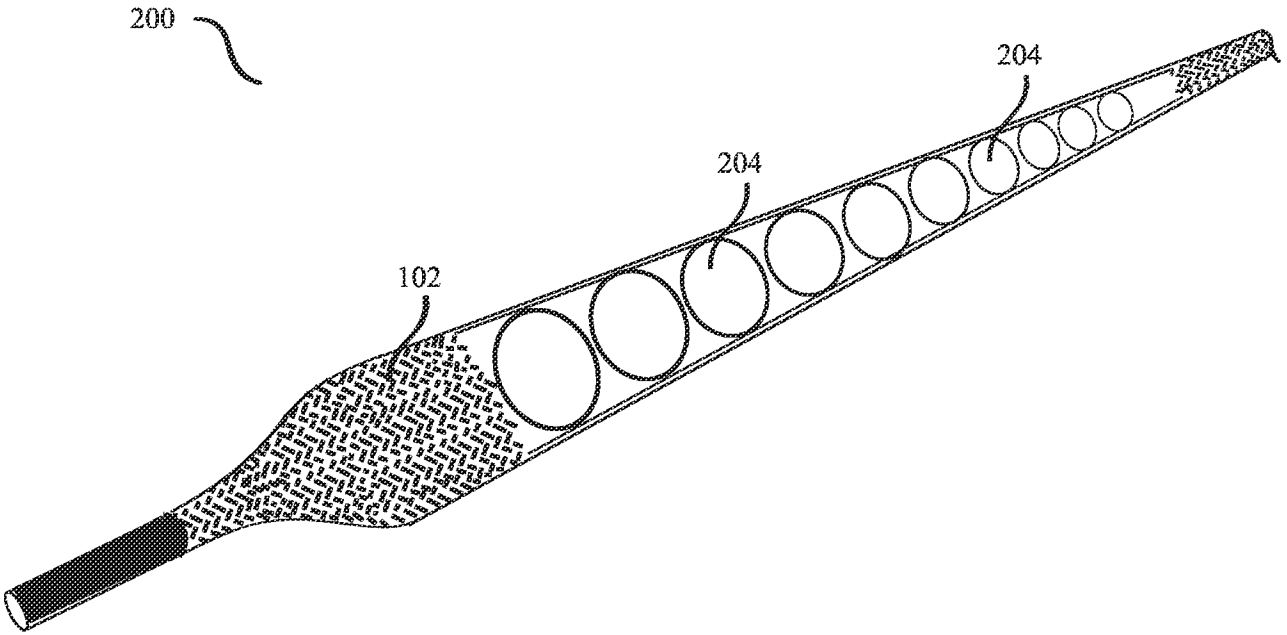
FIG. 3 is a perspective view of a part of a slip resistant shoelace with round beads in accordance with an embodiment of the present embodiment.
Figure 4:
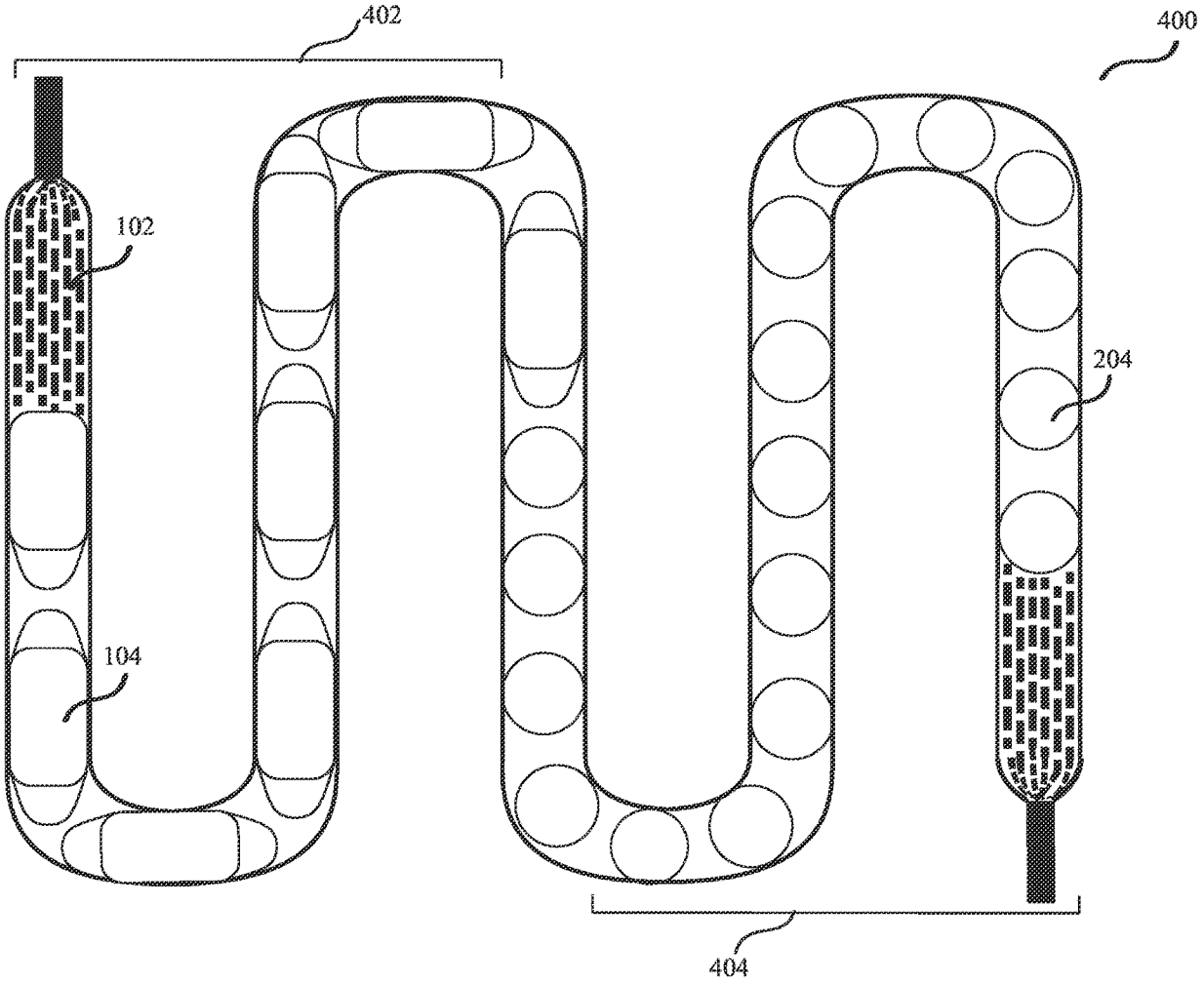
FIG. 4 is a plan view of a full length slip resistant shoelace with elongated and round beads in accordance with an embodiment of the present embodiment.
Figure 5:
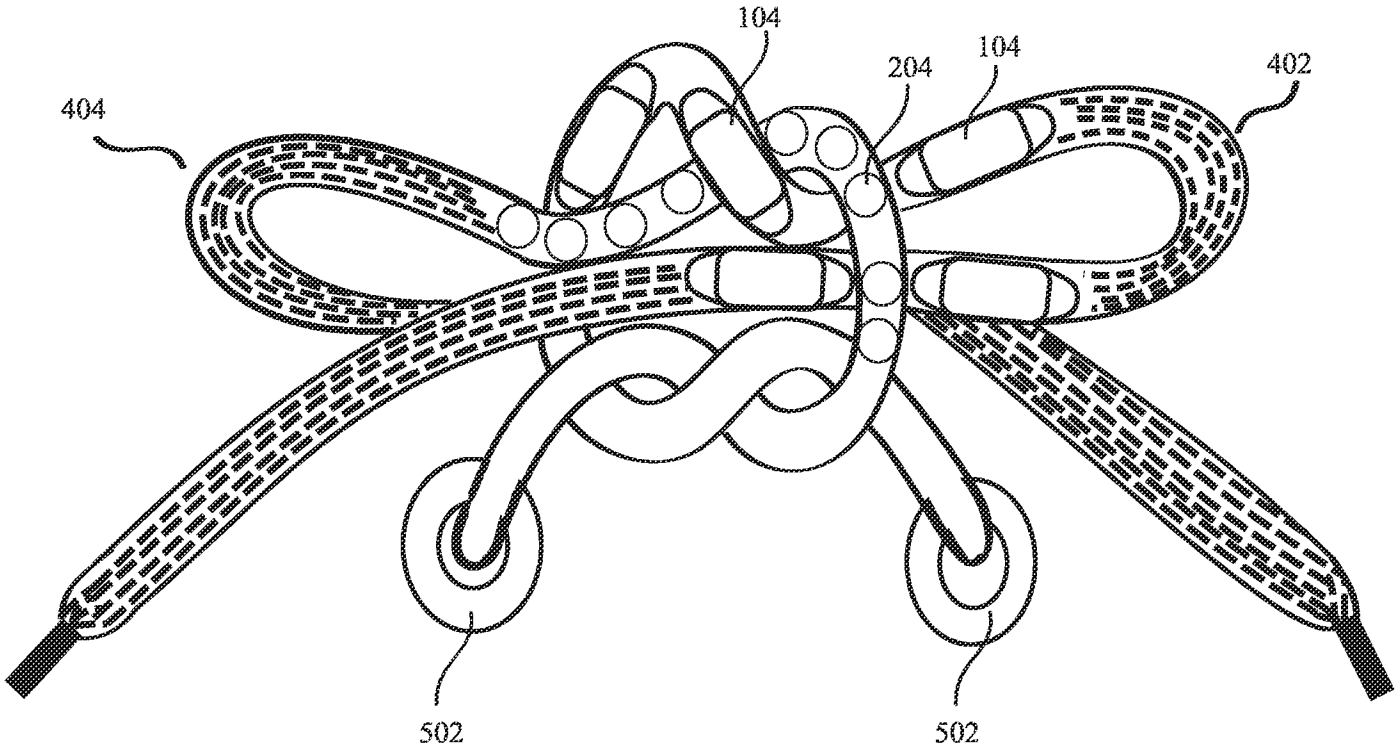
FIG. 5 illustrates a slip resistant shoelace in knotted condition in accordance with an embodiment of the present embodiment.

FIG. 3 shows another embodiment of the slip resistant shoelace 100 in which plurality of rounded beads 104 are sewed or glued inside the shoelace tube 102. In a preferred embodiment, as shown in FIG. 4, plurality of elongated beads 104 are lined inside first half 402 of the shoelace tube 102 whereas plurality of rounded beads 204 are lined up inside the second half 404 of the shoelace tube 102 of the slip resistant shoelace 400. FIG. 5 shows the intended use of the slip resistant shoelace of the present invention. As shown in FIG. 5, when the slip resistant shoelace 400 is passed through the eyelets 502 of a shoe and a knot is tied using the free ends of the first half 402 and the second half 404, the beads of one half of the slip resistant shoelace 400 get interlocked with those of other half of the shoelace where the shoelace ends cross each other in a tightened knot. The beads of the same half of the shoelace can also get interlocked with each other when two sections of the same half of the shoelace remains pressed against each other. For example, as shown in FIG. 5, one or more beads 104 of first half 402 of slip resistant shoe lace 400 may fall in the space provided between two consecutive beads 204 of the second half 404 of slip resistant shoe lace 400 at the points where the shoelace ends pass over or cross each other and in close contact. Similarly, in the same knot, wherever the portions of the shoelace 400, of the same shoelace end or of the opposite ends, remain pressed against each other, the beads 104 and 204 would try to fill-in the spaces available between two consecutive beads in the opposite portion of the shoelace 400. The engagement of beads 104 and 204 with each other occurs in a manner similar to a male-female interlocking and this engagement offers resistance against slipping of the ends of a shoelace 400 relative to each other in a knot once the knot is tightened, thereby preventing inadvertent untying or loosening of a knot. The size and shape of the beads and the interval provided between two consecutive beads are designed to ensure that whenever two sections of the slip resistant shoelace of the present invention cross over each other in a knot, one or more beads of one section of the slip resistant shoelace always find space to fit in between two or more beads of the opposite section of the shoelace. All the different embodiments of the slip resistant shoelace of the present invention work on this same principle of interlocking beads or bumps or to resist loosening or slipping of a knot.

Figure 6:
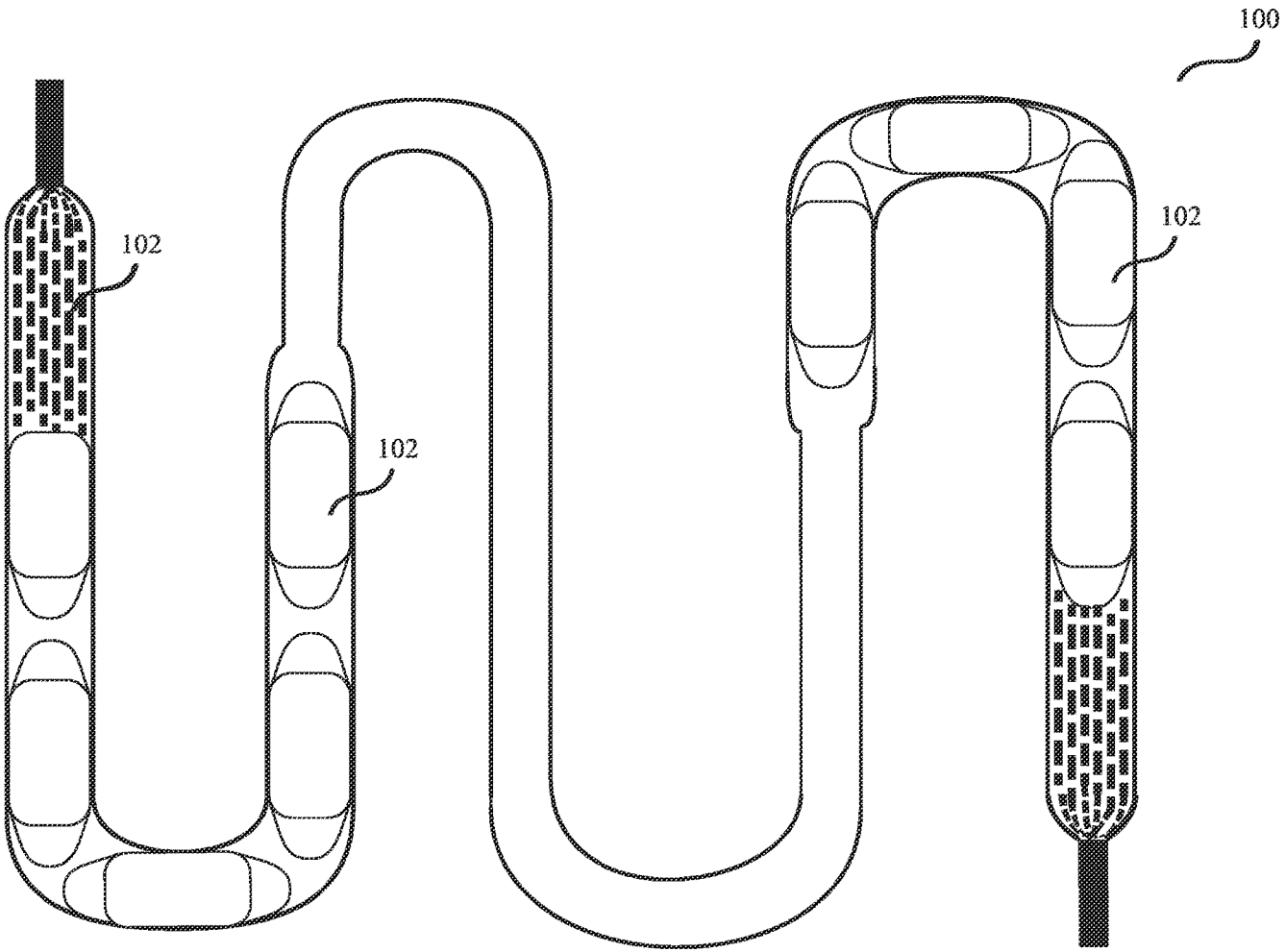
FIG. 6 is a plan view of a full length slip resistant shoelace suitable for factory fit with shoes in accordance with an embodiment of the present embodiment.

FIG. 6 illustrates a slip resistant shoelace 600 suitable for factory fit with shoes. As shown in the FIG. 6, the middle section 602 of the slip resistant shoelace 600 is made as a normal shoelace excluding any beads or bumps and this middle portion 602 goes through the multiple eyelets of a shoe. The end sections of the slip resistant shoelace 600 are made similar to the shoelaces shown in FIG. 1 through FIG. 4 with plurality of beads 104 sewn or glued inside the shoelace tube 102 and these end sections remain loose outside the uppermost eyelets of a shoe.

Figure 7:
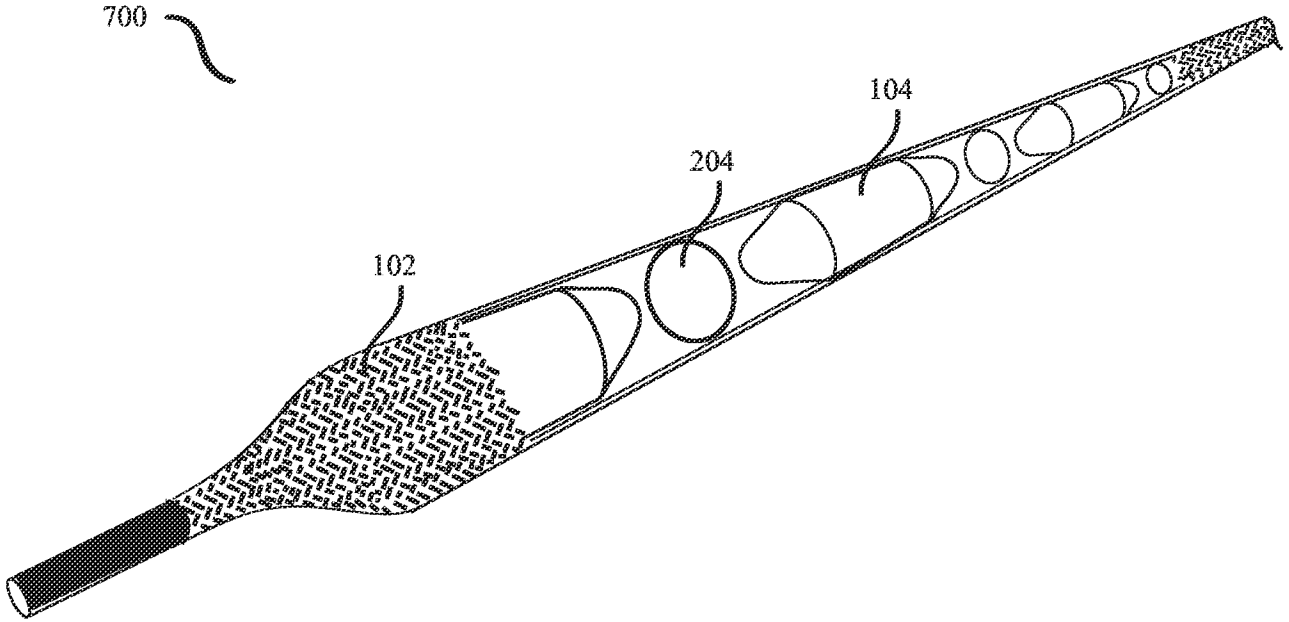
FIG. 7 is a perspective view of a part of a slip resistant shoelace with combination of elongated beads and round beads in accordance with an embodiment of the present embodiment.

FIG. 7 illustrates another embodiment of the present invention wherein slip resistant shoelace 700 has plurality of beads of different shapes and sizes lined inside the shoelace tube 102. In FIG. 7, plurality of beads 104 and 204 are arranged alternatively inside the shoelace tube 102. Similarly, various combinations of differently designed beads can be arranged inside the shoelace tube 102 in other embodiments of the present invention.

Figure 8:
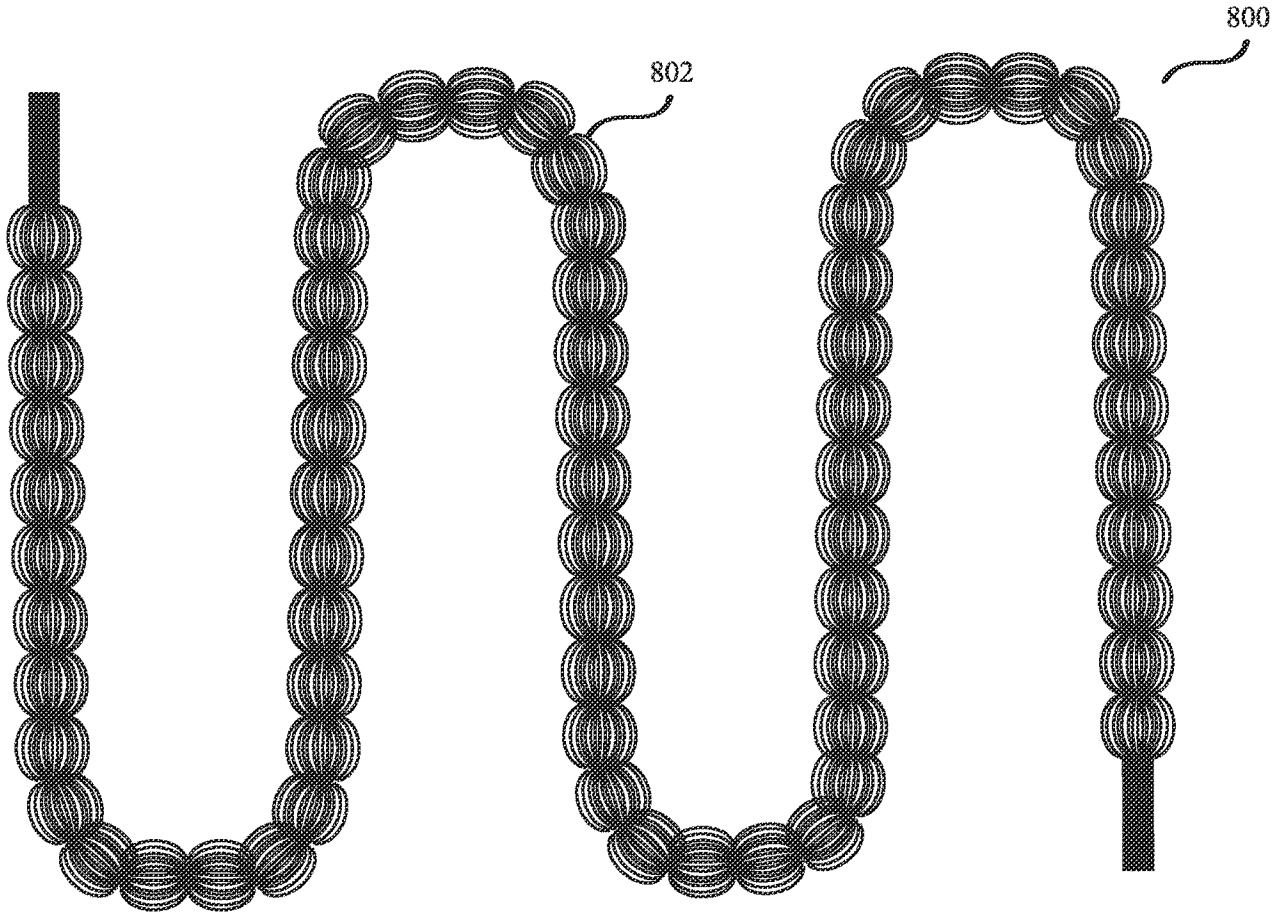
FIG. 8 is a plan view of a full length slip resistant shoelace with woven beads in accordance with an embodiment of the present embodiment.

In some embodiments of the slip resistant shoelace of the present invention, the shoelace tube itself can be woven or melt staked to have plurality of uneven cross-sections along the length of the shoelace tube at regular or irregular intervals. Examples of such uneven cross-sections include, but not limited to, bumps of various sizes and shapes without using beads inside the shoelace tube. For example, as shown in FIG. 8, the slip resistant shoelace 800 can be woven to have bumps 802 throughout the length of the shoelace 800 at regular intervals. These bumps 802 of the ends of shoelace 800 will engage with each other in a knot and resist loosening of the knot.

In some shoes it may be difficult to pass the slip resistant shoelaces through the eyelets if the beads or bumps of the slip resistant shoelaces are bigger in size than the eyelets. To overcome this problem, beads made of elastic material may be used so that the beads can be squeezed through the eyelets and the beads regain their shape thereafter. In case of embodiment similar to shown in FIG. 8, the shoelace tube can be fabricated from elastic material so that the bumps can pass through eyelets smaller than the bump size.

Figure 10:
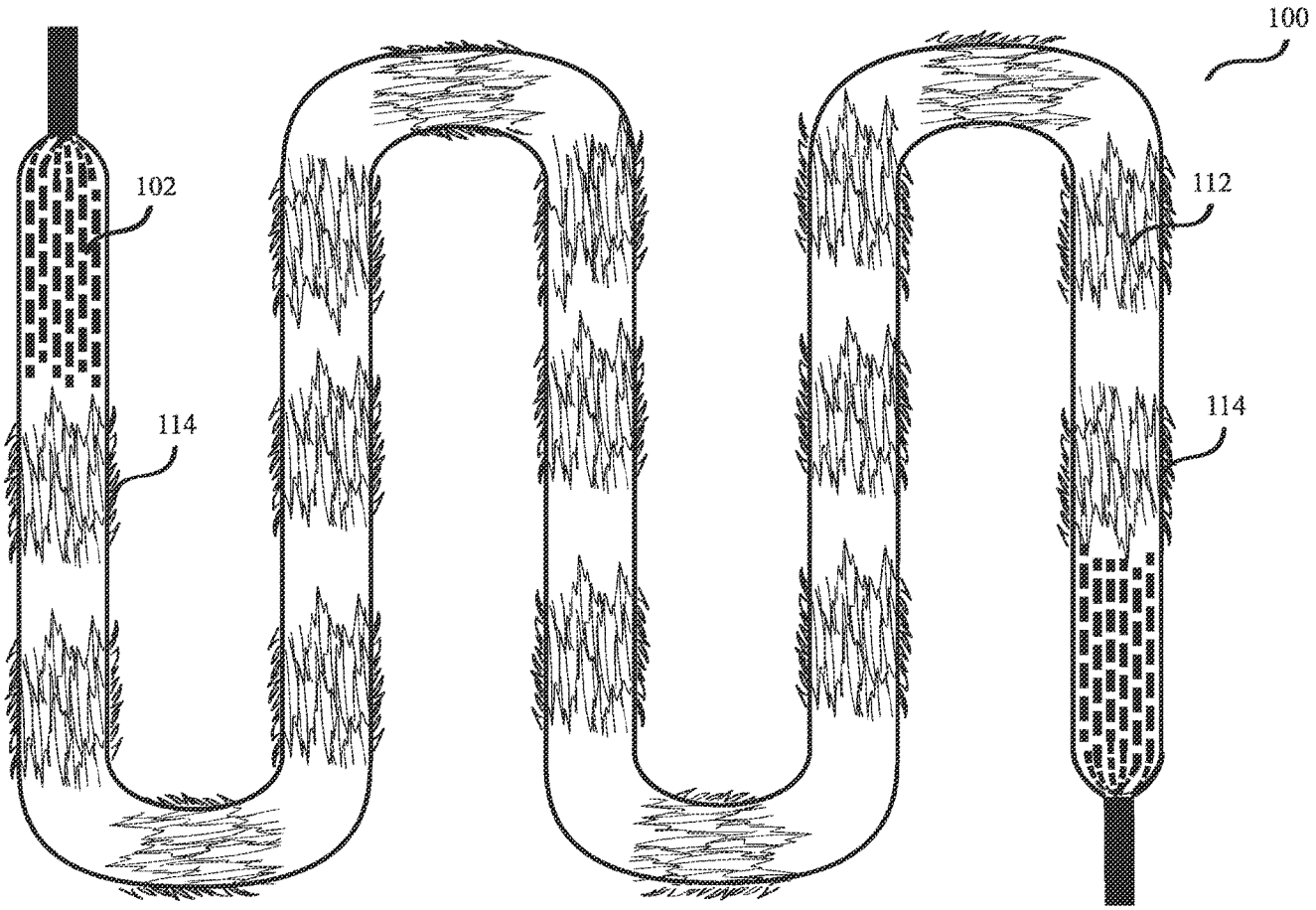
FIG. 10 is a plan view of a full length slip resistant shoe lace with friction inducing material sewn, woven, glued or staked along the periphery of the shoelace tube in accordance with an embodiment of the present invention.

In some shoes it may be difficult to pass the slip resistant shoelaces through the eyelets if the beads or bumps of the slip resistant shoelaces are bigger in size than the eyelets, or for other design purposes it is desired to avoid beads. In an alternate embodiment, to overcome this problem, friction inducing features are sewn, woven, staked or glued into the periphery of the shoelace tube material. As shown in FIG. 10, friction inducing material 112 having barbs or serrated edges 114 is added to the exterior of the shoelace tube 102. These pluralities of serrated edges 114 from the sections of the shoelace tube 102 in contact in a knot interlock with each other and resist slipping from the knot.

Figure 9:
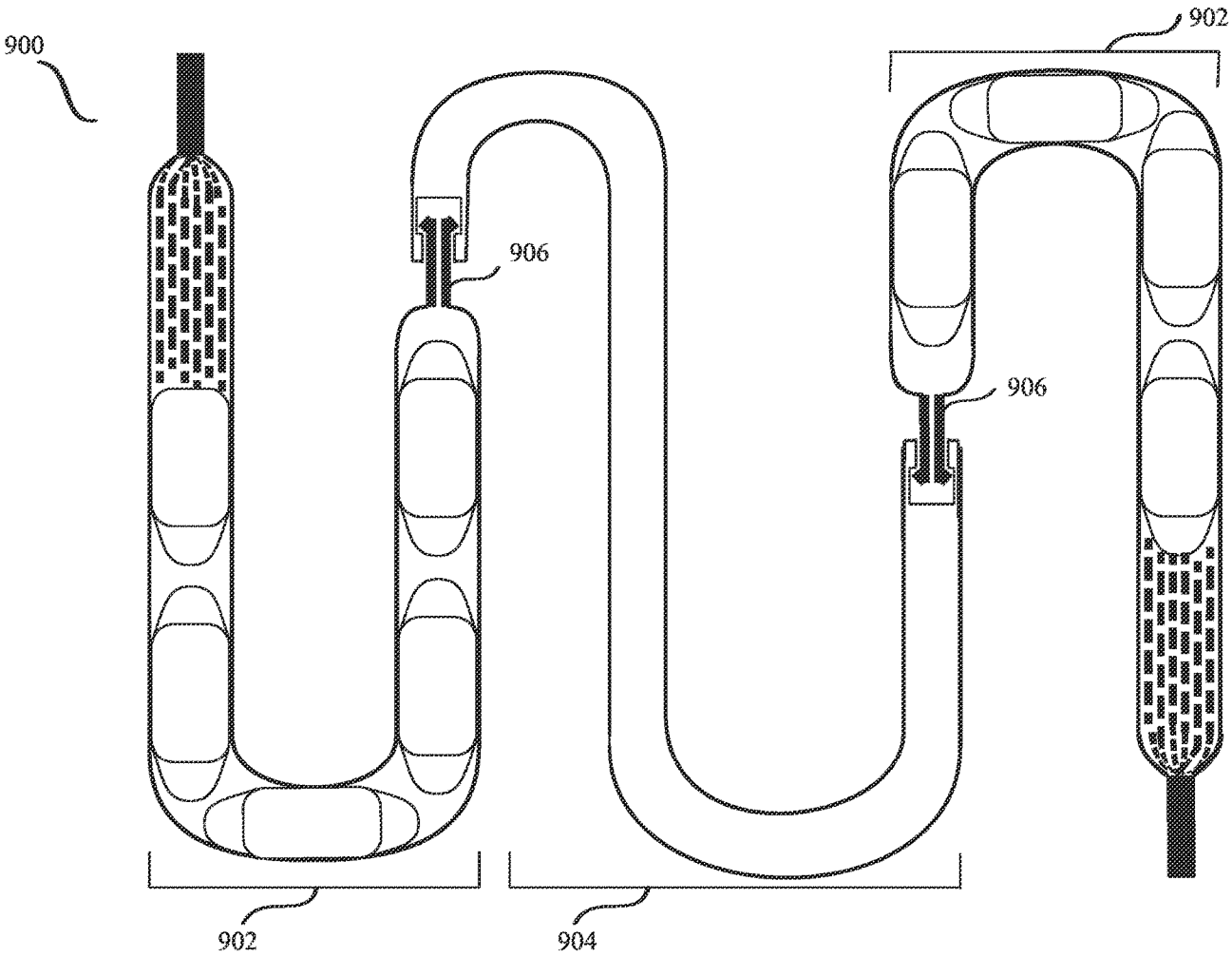
FIG. 9 is a plan view of a full length three piece slip resistant shoelace in accordance with an embodiment of the present embodiment.

In another embodiment, the slip resistant shoelace 900 of the present invention can have plurality of detachably attachable sections with beads sewn or stacked inside shoelace tube of some of the sections and with smooth conventional shoelace body without having beads or bumps for some other sections. This embodiment of the present invention is particularly suitable for retrofit in shoes (aftermarket) or to overcome the small eyelet problem. As shown in FIG. 9, the middle section 904 of the slip resistant shoelace 900 is made like a normal conventional shoelace without having any beads inside or bumps so that section 904 can easily pass through the eyelets of a shoe. The end sections 902 of the slip resistant shoelace 900 can then be attached to the ends of the middle section 902 to form the loose ends of shoelaces. As shown in FIG. 9, snap fit type of locking arrangement 906 can be used for attachment of the end sections 902 to the middle section 904.

It is evident from the above description that the slip resistant shoelace of the present invention does not entail any change in the design of a shoe and also requires no extra accessory to keep a shoelace knot intact and tight.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims.

What is claimed is:

1. A slip resistant shoelace, comprising:

a shoelace tube; and a plurality of elongated beads disposed inside said shoelace tube with a rounded end of each of said plurality of elongated beads oriented toward an aglet end of said shoelace tube and a squared end of said each of said plurality of elongated beads oriented away from said aglet end;

wherein said rounded end enables feeding of said slip resistant shoelace through a plurality of eyelets of a shoe and said squared end resists relative movement in an interlocking that occurs as one or more beads of said plurality of elongated beads of one section of said slip resistant shoelace fit in space available between two consecutive beads of said plurality of elongated beads of another section of said slip resistant shoelace which are passing over each other in a knot.

2. The slip resistant shoelace as in claim 1, wherein said plurality of elongated beads are disposed inside said shoelace tube by sewing, gluing or by any other suitable method known in the art.

3. The slip resistant shoelace as in claim 1, wherein said plurality of elongated beads are attached inside said shoelace tube at regular intervals.

4. The slip resistant shoelace as in claim 1, wherein said plurality of elongated beads are attached inside said shoelace tube at irregular intervals.

5. The slip resistant shoelace as in claim 1, wherein said shoelace tube is woven using any commonly used fabric-polyester or cotton or can be fabricated using any other suitable material known in the art.

6. The slip resistant shoelace as in claim 1, wherein said plurality of elongated beads are made from rubber, viscoelastic silicone, glass, plastic, wood, metal or any other suitable material known in the art.

7. The slip resistant shoelace as in claim 6, wherein said plurality of elongated beads when made of rubber, have hardness in the range of 40 international rubber hardness degrees (IRHD) to 80 international rubber hardness degrees (IRHD).

8. The slip resistant shoelace as in claim 1, wherein said plurality of elongated beads placed inside said shoelace tube are of same size.

* * * * *